United States Patent [19]

Saito et al.

[11] 4,119,892

[45] Oct. 10, 1978

[54] LIGHT EMITTING INDICATING CIRCUIT FOR A TIMEPIECE

[75] Inventors: Takeo Saito; Takashi Segawa, both of Yotsukaido, Japan

[73] Assignee: Seiko Koki Kabushiki Kaisha, Japan

[21] Appl. No.: 741,121

[22] Filed: Nov. 11, 1976

[51] Int. Cl.[2] ..... G04C 3/00

[52] U.S. Cl. ..... 318/138; 58/23 R; 58/85.5

[58] Field of Search ..... 58/23 R, 23 D, 85.5; 318/138, 171, 696

[56] References Cited

U.S. PATENT DOCUMENTS

| | | | |
|---|---|---|---|
| 3,712,045 | 1/1973 | Ito | 58/23 R |
| 3,841,087 | 10/1974 | Kikuchi | 58/23 R |

*Primary Examiner*—Herman J. Hohauser

*Attorney, Agent, or Firm*—Robert E. Burns; Emmanuel J. Lobato; Bruce L. Adams

[57] ABSTRACT

A light emitting indicating circuit comprises a first and second inverter circuit which are each comprised of a pair of complementary transistors connected in series. A motor driving coil and a capacitor are connected in series between respective outputs of the inverter circuits, and the inverter circuits are effective for applying repetitive complementary electrical driving signals for repetitively flowing a current in alternating directions through the series combination of motor driving coil and capacitor to repetitively energize the motor driving coil. An indicating circuit responsive to the electrical driving signals indicates energization of the motor driving coil. The indicating circuit is comprised of a light emitting diode connected in parallel with the motor driving coil for emitting light to indicate energization of the motor driving coil.

8 Claims, 6 Drawing Figures

LIGHT EMITTING INDICATING CIRCUIT FOR A TIMEPIECE

Background of the Invention

The present invention relates to an indicating circuit having a light emitting diode for usually indicating a synchronous signal and more particularly to a light emitting indicating circuit for a timepiece for indicating energization of a motor driving coil of the timepiece.

In case of using a light emitting diode as light emitting element, a voltage at leaset over 1.6 V is needed to recognize the light emission. Therefore, it was heretofore impossible to employ a light emitting diode in a low-voltage circuit using a battery. On the other hand, a system of driving a clock motor wherein a current flows through a motor driving coil by reversing the direction of the current at each half unit time period can be used in a battery powered device.

SUMMARY OF THE INVENTION

It is therefore an object of the present invention to provide a light emitting indicating circuit, which can be used with a battery powered device and particularly a battery powered timepiece, for indicating operation of the device.

It is another object of the present invention to provide a light emitting indicating circuit as described above, wherein the indicating circuit incorporates a light emitting diode to indicate operation of the device.

According to the present invention driving means is connected for applying repetitive complementary electrical driving signals to opposite sides of a series combination of a motor driving coil and a capacitor to repetitively flow current in alternating directions through the series combination to repetitively energize the motor driving coil. Indicating means responsive to the electrical driving signals indicates energization of the motor driving coil. In one embodiment the indicating means is comprised of a light emitting diode connected in parallel with the motor driving coil for repetitively emitting light to indicate energization of the motor driving coil by the electrical driving signals. In another embodiment the indicating means is comprised of a pair of light emitting diodes connected with opposed polarities in parallel with the motor driving coil. In another embodiment the indicating means is comprised of a series combination of a second capacitor and a resistor connected in parallel with the series combination of the first-mentioned capacitor and the motor driving coil. In still another embodiment of the invention the indicating means is comprised of a series combination of a second capacitor and a resistor connected in parallel with the series combination of the first-mentioned capacitor and the motor driving coil, and a pair of light emitting diodes connected with opposed polarities in parallel with the resistor. The driving means is comprised of two inverter circuits, each comprised of a complementary pair of field effect transistors connected in series and having respective gate terminals connected together to define an input terminal of the inverter circuit. Each of the inverter circuits have respective output terminals for developing thereat the electrical driving signals.

DESCRIPTION OF THE PREFERRED EMBODIMENTS

Figure 1:
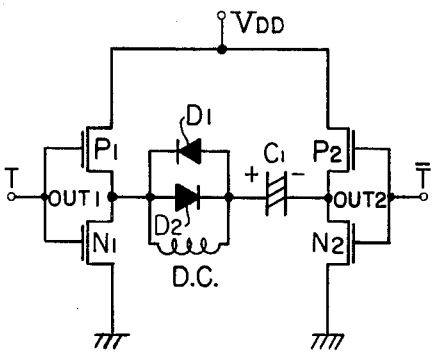
FIG. 1 shows an embodiment of the indicating circuit according to the present invention.

As shown in FIG. 1 the present invention is comprised of a first inverter circuit which is comprised of a complementary pair $P_1$, $N_1$ of field effect transistors, and a second inverter circuit which is comprised of a complementary pair $P_2$, $N_2$ of complementary field effect transistors. The transistors $P_1$, $P_2$ are P channel devices, and the transistors $N_1$, $N_2$ are N channel transistors.

The gate terminals of the respective transistors in each of the inverter circuits are connected together to define respective input terminal T, $\overline{T}$ of the inverter circuits. Similarly, each of the inverter circuits have a respective output terminal or node OUT 1, OUT 2. A motor driving coil DC and a capacitor $C_1$ are connected in series between the respective output terminals of the inverter circuits. And in this embodiment, a pair of light emitting diodes $D_1$, $D_2$ connected with opposed polarities are connected in parallel with the motor driving coil DC.

In operation, a power signal $V_{DD}$ is applied to the pair of inverter circuits. A pair of complementary repetitive gate signals are applied to the respective input terminals to enable the inverter circuits to develop complementary electrical driving signals at their respective output terminals. The pair of inverter circuits constitute driving means connected for applying repetitive complementary electrical driving signals to opposite sides of the series combination of the motor driving coil DC and the capacitor $C_1$. Similarly, the pair of diodes D1, D2 constitute indicating means responsive to the electrical driving signals for indicating energization of the motor driving coil DC. When the level of OUT 1 is 1 and the level OUT 2 is "0", the transistors $P_1$, $N_2$ become conductive and the transistors $P_2$, $N_1$ become non-conductive. Then the capacitor $C_1$ between OUT 1 and OUT 2 is charged in the direction shown in the figure up to the electric source voltage $V_{DD}$.

From this state, when the inverter outputs or driving signals are reversed to make OUT 1 be "0" and OUT 2 be "1", a charging current flows in the condenser $C_1$ in the opposite direction through $P_2$, $N_1$, while at the moment of reversal a voltage of about 2 $V_{DD}$ is applied to a light emitting diode $D_1$ in the normal or conductive direction, a current in the normal direction flows through $D_1$ to make it emit light. But as the charging current is gradually decreased, the light emission is stopped at about a few ms to a few 10ms and the resistance value of $D_1$ becomes extremely large, then the charge is finished through a motor driving coil connected in parallel with $D_1$. In this way, since a voltage of about two times the electric source voltage is impressed on $D_1$, the light emission will be possible up to about 1V of $V_{DD}$.

Figure 3:
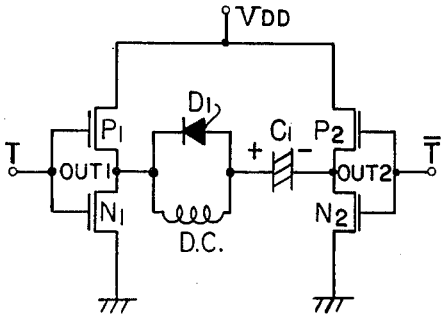
FIG. 3 a second embodiment of the invention wherein the number of the light emitting diodes in FIG. 1 is reduced to one.

Next, when the output is reversed and OUT 1 becomes "1" and OUT 2 becomes "0", a charging current flows in the opposite direction to the above, making the light emitting diode $D_2$ emit light. In such a way, $D_1$, $D_2$ alternately emit light every 1 second. However, in case the output of OUT 1, OUT 2 are initially of 1Hz, it is quite natural that the light emitting diode $D_1$ is enough as shown in FIG. 3.

As described above, since in this invention, the single condenser can be concurrently used for driving a motor and for energizing a light emitting display, moreover, since the back voltages at both ends of the motor driving coil are shunted in the normal direction voltage of the light emitting diode, even though the electric source voltage $V_{DD}$ is changed, the current flowing through the motor driving coil remains constant owing to the aforementioned constant voltage character, there is an advantage resulting in an exceedingly large improvement in the motor operator.

Figure 4:
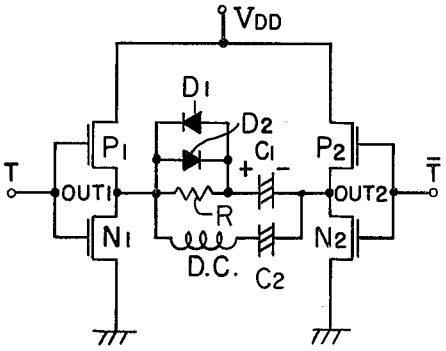
FIG. 4 shows another embodiment.
Figure 2:
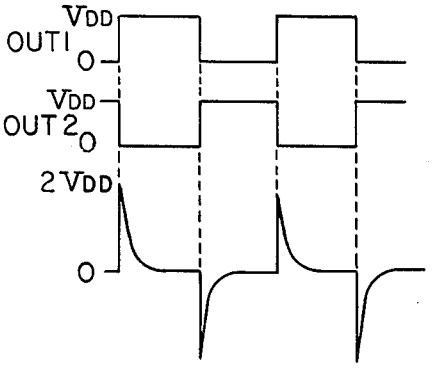
FIG. 2 illustrates waveforms of voltages developed during operation of the circuit shown in FIG. 1.
Figure 5:
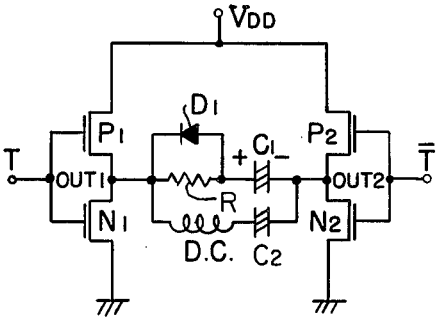
FIG 5 illustrates an embodiment wherein the number of light emitting diodes in FIG. 4 was reduced to one.

In another embodiment shown in FIG. 4, a motor driving coil and a condenser $C_1$ are connected between OUT 1 and OUT 2, and further a resistance R is connected in parallel to $D_1$, and $D_2$ and a condenser $C_2$ is connected in series with the motor driving coil. In this case, the resistance R is necessarily required for charging the capacitor $C_1$. It is also possible to employ only one diode as shown in FIG. 5, provided that the outputs signals at OUT 1, OUT 2 are 1Hz. If the light emitting diodes $D_1$, $D_2$ are positioned separately from each other for viewing from outside the clock they can be seen to alternately emit light every 1 second.

Figure 6:
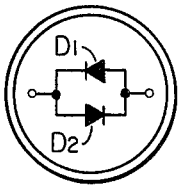
FIG. 6 shows an example of the light emitting diodes.

Moreover, it is possible to make the light emitting diodes $D_1$, $D_2$ emit light every second at a same place, if they are formed on the same chip and housed within one package as shown in FIG. 6.

We claim:

1. A light emitting indicating circuit for a timepiece, comprising: a first inverter circuit comprised of a first pair of complementary transistors; a second inverter circuit comprised of a second pair of complementary transistors and connected for developing an output signal having a polarity opposite that of said first inverter circuit; a motor driving coil and a capacitor connected in series between respective outputs of said first and second inverter circuits for energizing said motor driving coil with the output signals developed by said inverter circuits; and a light emitting diode connected in parallel with said motor driving coil for emitting light to indicate energization of said motor driving coil.

2. A light emitting indicating circuit for a timepiece, comprising: a first inverter circuit comprised of a first pair of complementary transistors; a second inverter circuit comprised of a second pair of complementary transistors and connected for developing an output signal having a polarity opposite that of said first inverter circuit; a motor driving coil and a first capacitor connected in series between respective outputs of said first and second inverter circuits for energizing said motor driving coil with the output signals developed by said inverter circuits; and a parallel combination of a resistor and a light emitting diode, and a second capacitor connected in series with said parallel combination, all connected in parallel with the series combination with said motor driving coil and said first capacitor for emitting light to indicate energization of said motor driving coil.

3. In an electric timepiece; a motor driving coil and a capacitor connected in series; driving means connected for applying repetitive complementary electrical driving signals to opposite sides of the series combination of said motor driving coil and said capacitor to repetitively flow current in alternating directions through the series combination of said motor driving coil and said capacitor to repetitively energize said motor driving coil; and indicating means responsive to the electrical driving signals for indicating energization of said motor driving coil.

4. In an electric timepiece according to claim 3 wherein said indicating means is comprised of a light emitting diode connected in parallel with said motor driving coil for repetitively emitting light to indicate energization of said motor driving coil by said electrical driving signals.

5. In an electric timepiece according to claim 3 wherein said indicating means is comprised of a pair of light emitting diodes connected with opposed polarities in parallel with said motor driving coil for alternately and repetitively emitting light to indicate energization of said motor driving coil by said electrical driving signals.

6. In an electric timepiece according to claim 3 wherein said indicating means is comprised of a series combination of a second capacitor and a resistor connected in parallel with the series combination of the first-mentioned capacitor and said motor driving coil; and a light emitting diode connected in parallel with said resistor for repetitively emitting light in response to said electrical driving signals to indicate energization of said motor driving coil.

7. In an electric timepiece according to claim 3 wherein said indicating means is comprised of a series combination of a second capacitor and a resistor connected in parallel with the series combination of the first-mentioned capacitor and said motor driving coil; and a pair of light emitting diodes connected with opposed polarities in parallel with said resistor for alternating and repetitively emitting light in response to said electrical driving signals to indicate energization of said motor driving coil.

8. In an electric timepiece according to claim 3 wherein said driving means is comprised of two inverter circuits, each of said inverter circuits comprising a complementary pair of field effect transistors connected in series and having respective gate terminals connected together to define an input terminal of the inverter circuit, and each of said inverter circuits having respective output terminals for developing thereat said electrical driving signals; and wherein said inverter circuits receive in use a power signal applied to the respective transistor pairs and complementary gate signals applied to the respective input terminals of said inverts for enabling said inverters to develop said electrical driving signals.

* * * * *

UNITED STATES PATENT AND TRADEMARK OFFICE

CERTIFICATE OF CORRECTION

PATENT NO. 4,119,892

DATED : October 10, 1978

INVENTOR(S) : TAKEO SAITO and TAKASHI SEGAWA

It is certified that error appears in the above-identified patent and that said Letters Patent are hereby corrected as shown below:

In the patent heading:

[30] Foreign Application Priority Data

Nov. 13, 1975 Japan..... 50-136592

Signed and Sealed this

*Eighth* Day of *May 1979*

[SEAL]

*Attest:*

RUTH C. MASON
*Attesting Officer*

DONALD W. BANNER
*Commissioner of Patents and Trademarks*